US009428889B2

(12) United States Patent
Reiman

(10) Patent No.: US 9,428,889 B2
(45) Date of Patent: Aug. 30, 2016

(54) HOUSEHOLD FAUCET SPRAY

(71) Applicant: Oy Grana Finland Ab, Toijala (FI)

(72) Inventor: Hannu Reiman, Tuusula (FI)

(73) Assignee: Grana Oy, Akaa (FI)

( * ) Notice: Subject to any disclaimer, the term of this patent is extended or adjusted under 35 U.S.C. 154(b) by 137 days.

(21) Appl. No.: 13/795,043

(22) Filed: Mar. 12, 2013

(65) Prior Publication Data

US 2013/0248010 A1 Sep. 26, 2013

(30) Foreign Application Priority Data

Mar. 23, 2012 (FI) ..... 20125332

(51) Int. Cl.

| | |
|---|---|
| ***A46B 11/06*** | (2006.01) |
| ***E03C 1/04*** | (2006.01) |
| ***A47L 17/00*** | (2006.01) |
| ***E03C 1/086*** | (2006.01) |
| ***A46B 9/00*** | (2006.01) |

(52) U.S. Cl.

CPC ..... *E03C 1/04* (2013.01); *A46B 9/005* (2013.01); *A46B 11/06* (2013.01); *A47L 17/00* (2013.01); *E03C 1/086* (2013.01); *Y10T 137/598* (2015.04)

(58) Field of Classification Search

USPC ..... 401/282, 284, 285, 289

See application file for complete search history.

(56) References Cited

U.S. PATENT DOCUMENTS

| | | | | |
|---|---|---|---|---|
| 1,410,620 | A * | 3/1922 | Strieff | 401/203 |
| 2,265,804 | A | 12/1941 | Deady | |
| 2,513,776 | A | 7/1950 | Anderson et al. | |
| 2,779,962 | A | 2/1957 | Cooper | |
| 3,009,190 | A * | 11/1961 | Awot | 401/46 |
| 3,063,084 | A * | 11/1962 | Marinus | 401/203 |
| 3,359,591 | A * | 12/1967 | Mcguire | 401/203 |
| 4,165,942 | A * | 8/1979 | Johansson | 401/132 |
| 4,332,250 | A * | 6/1982 | Behney | 604/517 |
| 6,270,278 | B1 * | 8/2001 | Mauro | 401/289 |
| 6,602,010 | B1 * | 8/2003 | Doyle et al. | 401/203 |
| 8,342,768 | B1 * | 1/2013 | Johnston et al. | 401/289 |

FOREIGN PATENT DOCUMENTS

| | | |
|---|---|---|
| FI | 840793 A | 8/1984 |
| GB | 565318 A | 11/1944 |

* cited by examiner

*Primary Examiner* — Jennifer C Chiang
(74) *Attorney, Agent, or Firm* — Ladas & Parry LLP

(57) ABSTRACT

The present invention relates to a household faucet spray (1) comprising a handle (2), the first end (3) of which is fixed mechanically to a water hose for supplying water inside the handle. The second end (6) is equipped with a sprayer head through which the water is arranged to discharge from the handle (2). The second end (6) is equipped with a water guiding piece (10, 110) which is provided with a plurality of apertures (13, 103). Around the guiding piece (10, 103) can be fitted a water-permeable washing piece (20, 20', 120) for the object to be washed, the water discharging through the plurality of apertures (13, 103) and the washing piece (20, 20', 120) being arranged to discharge in a controlled manner on the surface of the object to be washed.

17 Claims, 3 Drawing Sheets

HOUSEHOLD FAUCET SPRAY

Figure 3:
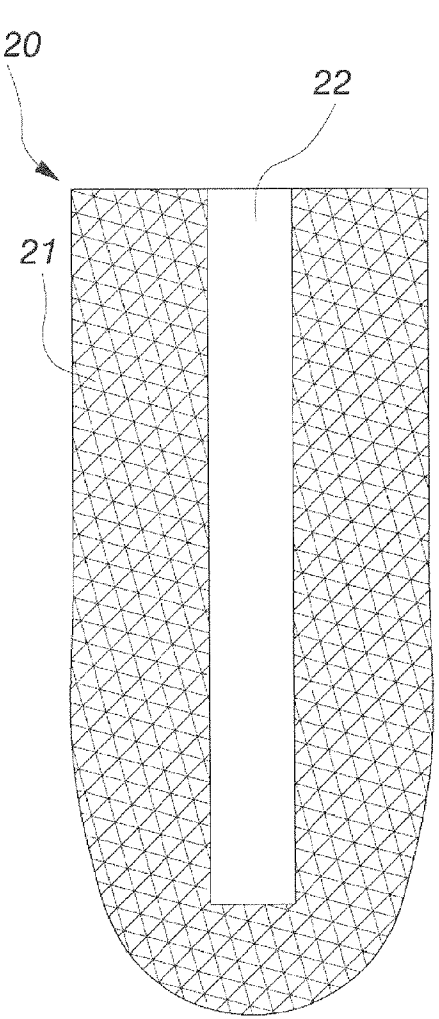

The present invention relates to a household faucet spray comprising a handle, the first end of which is fixed mechanically to a water hose for supplying water inside the handle and the second end of which is equipped with a sprayer head through which the water is arranged to discharge from the handle.

Previously are known household faucet sprays of the type described above, which are, for example, sprays located in connection with the kitchen sink which are separate from the kitchen sink faucet (so-called side sprays), to which water is supplied through their own water hose connected to the faucet mixer. In other words, to use this type of spray, the faucet is first turned on. The spray is typically located in a storage point, which is a shoulder provided in an aperture made in the kitchen sink, to which a counterpart in the spray handle fits. In addition are known household faucet sprays which are integrated in conjunction with kitchen faucets. These are so-called pull-out faucets in which the faucet head can be detached from the faucet body and used as a spray. Both types of household faucet sprays (faucets) are manufactured, for example, by Kohler Co. and American Standard.

The problem with these previously known household faucet sprays is in some cases their inefficiency in relation to the amount of water used for washing an object, especially if a dishwashing brush or the like is not used to facilitate washing. An example of this is washing grease off a barbeque base, where the grease is washed off by spraying water on the barbeque base until most of the grease has been removed with the water. On the other hand, when using a dishwashing brush or the like, it is difficult to use a household faucet spray because one then typically needs one hand for using the spray, one hand for holding the object being washed and one hand for holding the brush. One dishwasher is not, therefore, able to carry out these measures simultaneously, but will alternate between the brush and the spray or use the faucet continuously. As an example of this type of washing can be mentioned a wine glass or a baby feeding bottle. Water thus flows unnecessarily between brushings, which is unecological, or else the flow of water must be stopped in between by a faucet or other means regulating water flow, which is in turn inconvenient to the user. Furthermore, water discharged directly from a household faucet spray has to be discharged under high pressure, as a result of which water tends to splash into the surroundings, for example on the kitchen floor. Then again, water flow which is repeatedly turned on has to be adjusted to a suitable pressure each time in order to avoid the splashing of water. To put it briefly, using the known household faucet sprays is thus often inconvenient and/or unecological.

The aim of the present invention is to provide a household faucet spray by means of which the foregoing problems are avoided.

To achieve the above-mentioned aim, the present invention is characterised in that one end is equipped with a water guiding piece which is provided with a plurality of apertures and around which can be fitted a water-permeable washing piece for the object to be washed, the water discharging through the plurality of apertures and the washing piece being arranged to discharge in a controlled manner on the surface of the object to be washed.

By means of the household faucet spray is achieved the aim of the invention, that is, the discharge of water from the handle and the use of the washing piece can be controlled simultaneously with one hand. This is thus achieved by means of the plurality of apertures and the guiding piece equipped with a water-permeable washing piece.

Preferred embodiments of the present invention are disclosed in the dependent claims.

Figure 2:
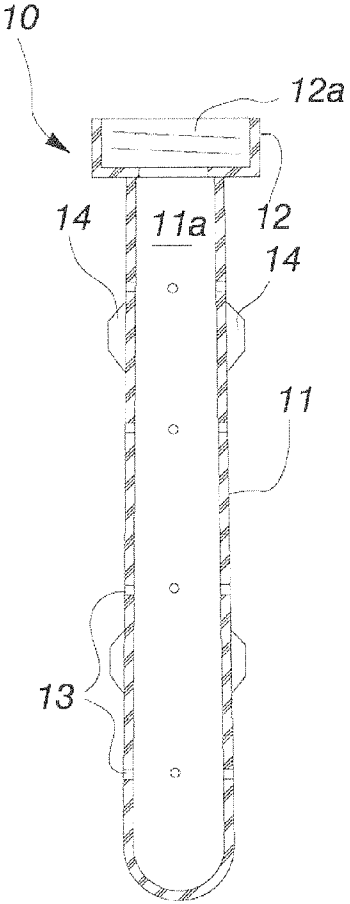
Figure 1:
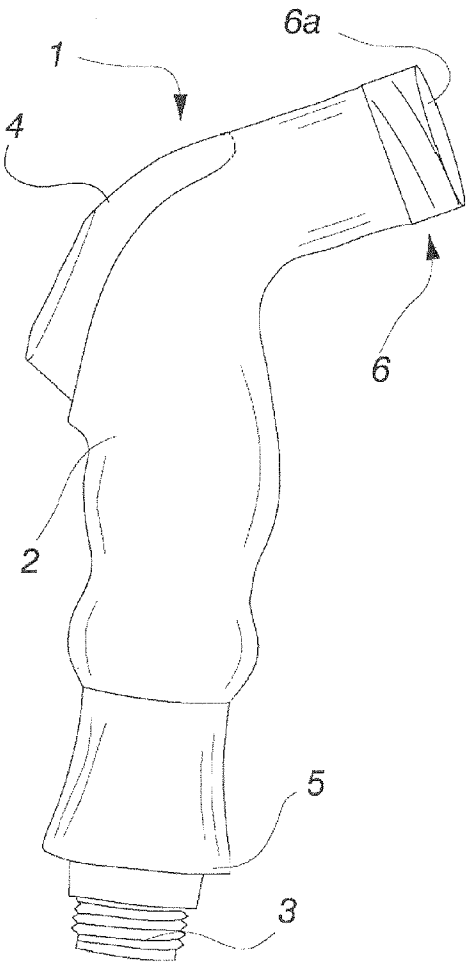
Figure 4:
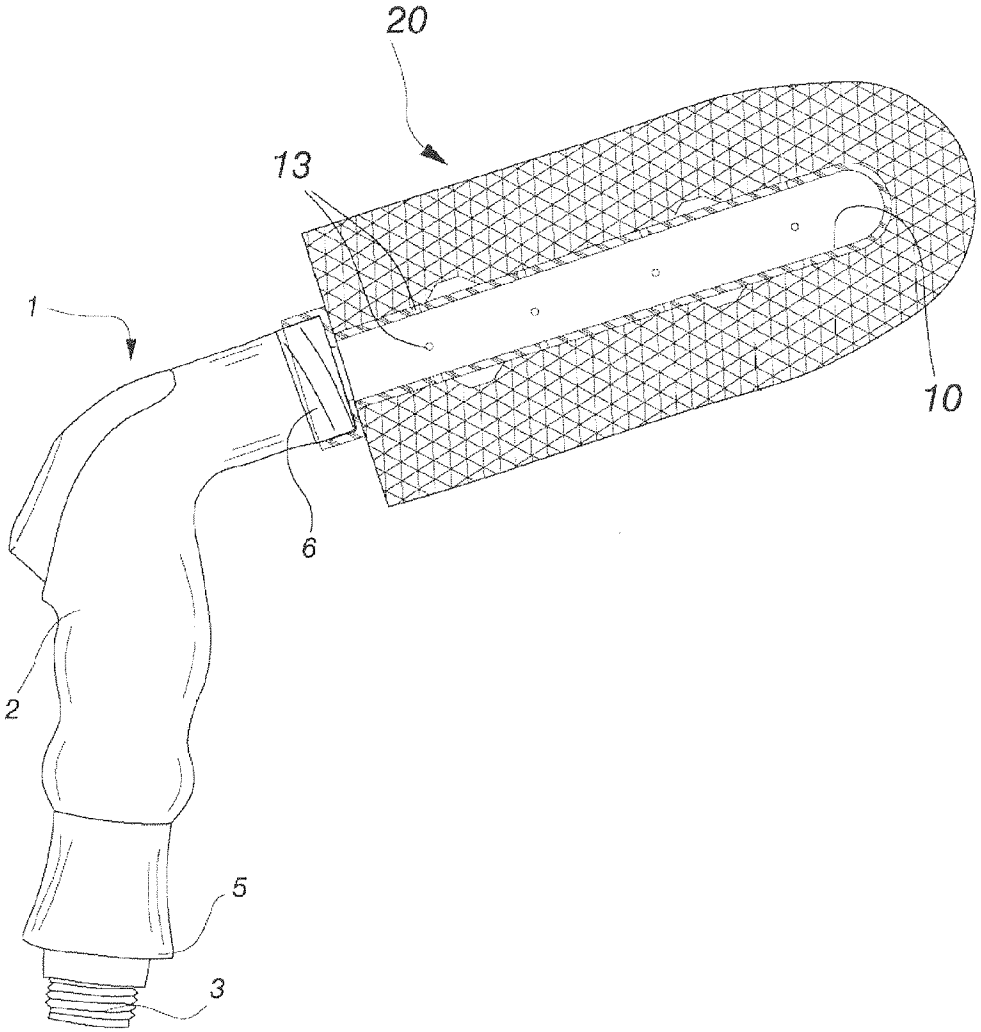
Figure 5:
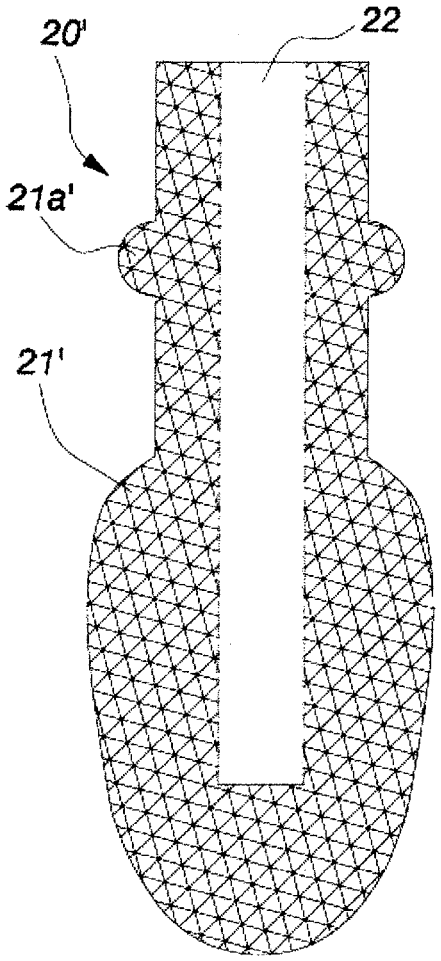
Figure 6:
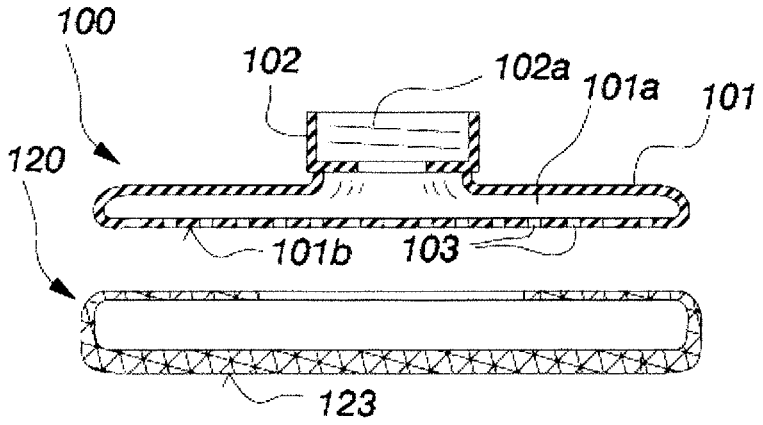

The invention is described in greater detail in the following, with reference to the accompanying drawings, in which:

FIG. 1 shows the handle of a household faucet spray according to a preferred embodiment of the invention, FIG. 2 shows a water guiding piece according to the invention, which is connected to the sprayer head of the handle of FIG. 1, FIG. 3 shows a preferred embodiment of the washing piece according to the invention, which is fitted around the guiding piece of FIG. 2, FIG. 4 shows the handle, guiding piece and washing piece shown in FIGS. 1 and 2 when joined together, FIG. 5 shows another preferred embodiment of the washing piece according to the invention, which is fitted around the guiding piece of FIG. 2, and FIG. 6 shows a water guiding piece according to another preferred embodiment of the invention and the washing piece fitted around it.

In FIG. 1 can be seen a household faucet spray according to the invention, which is marked with reference numeral 1. The household faucet spray 1 shown in FIG. 1 is preferably of the side spray type which is kept, for example, in a seat-like storage point located adjacent to the kitchen sink faucet and the water supply of which is typically connected to the faucet's water supply. The household faucet spray 1 comprises a handle 2 or a corresponding grip, the first end 3 of which is provided with fastening means known as such for fastening the water hose (not shown) to the first end 3.

The fastening means preferably comprise an external thread to which a connecting piece of the water hose comprising an internal thread is fitted in a sealing manner. The water supplied inside the handle 2 through the water hose is fed through the second end 6 equipped with a sprayer head in the desired direction by pressing the water feed push button 4 preferably located in the handle 2.

Prior art household faucet sprays trickle water for a short time after use. This is a problem especially when the handle is placed in its storage point immediately after use. The water trickles along the handle, through the storage point opening, to the supporting structures, typically the structures of the counter top and the cabinet surrounding the kitchen sink. This type of penetration of humidity into the structures is known to be extremely detrimental. To prevent the trickling of water, the first end 3 area is provided with an expanding water guiding collar 5 or a water guiding shoulder or the like, which can be brought in conjunction with the storage point of the household faucet spray 1. The water guiding collar 5 causes the water to be guided to a visible part of the surface of the counter top surrounding the storage point from where it can be immediately wiped off. The penetration of humidity to an undesirable point can be avoided at the same time.

The second end 6 of the household faucet spray 1 according to the invention is provided with the water guiding piece shown in an exemplary manner in FIG. 2, which is marked with reference numeral 10, and with the washing piece to be fitted around the guiding piece 10 shown in FIG. 3, which is marked with reference numeral 20. Here, the guiding piece 10 is structurally a hollow space 11*a* delimited by elongated walls 11, to which the water supplied from the second end 6 of the handle 2 discharges. The material of the guiding piece 10 is preferably highly wear-resistant and hard material, such as a durable plastic compound or a stainless metal alloy, such as an aluminium or a steel alloy. The guiding piece 10 is provided with fastening means 12 with which the guiding piece can be removably fastened to the second end 6 of the handle. The fastening means are preferably mechanical fastening means. The fastening means 12 of the guiding piece 10 preferably comprise a sleeve 12 with an internal thread 12*a*, which can be fitted in conjunction with an external thread 6*a* (see FIG. 1) formed at the second end 6 of the handle 2. As a second example may be mentioned fastening means 12 constituting a removable snap joint, in which case the guiding piece 10 can be pushed into place in its longitudinal direction. Thus, the water guiding piece 10 is a longitudinal extension of the second end 6 of the handle 2 (the longitudinal direction of the guiding piece 10 is essentially the direction of discharge of the water from the second end of the handle 2). FIG. 4 shows a guiding piece 10 fastened to the handle 2. The threads 12*a* and 6*a* have such steep pitches that the guiding piece 10 can be rapidly connected and disconnected. FIG. 2 further shows that the walls 11 of the guiding piece 10 are provided with apertures, or a plurality of apertures 13, the apertures 13 being spaced at appropriate intervals over the longitudinal distance of the guiding piece 10. The water supplied to the hollow space 11*a* is discharged in a controlled manner to the washing piece 20 fitted around the guiding piece 10.

FIG. 3 thus shows a preferred embodiment of the washing piece 20 which is suitable in shape and structure to be fitted around the guiding piece 10 shown in FIG. 2 and thus forms a so-called washing sponge to which the water discharges in the manner described above. The washing piece 20 is preferably made of porous, water-permeable, elastic material, such as polyurethane. Other materials are, for example, polyester, polyamide, polypropene and/or nonwoven fabric, which can be used separately or in combinations or as compounds. In the washing piece 20 is made a space 22 (in the example of FIG. 3 an elongated space) into which the guiding piece 10 can be fitted by inserting it in the longitudinal direction into the space 22, which preferably has a circular cross-section. The wall 21 of the washing piece 20, especially the wall of the space 22, stretches just enough for the washing piece 20 to be fixed tightly around the guiding piece 10, as shown in FIG. 4. Thus, the water supplied into the washing piece 20 finally discharges through the washing piece 20, that is, the washing sponge, from the washing piece, typically onto the surface of the object being washed, such as different glasses, plates and other dishes.

It should be noted that the shape of the guiding piece 10 shown in FIG. 2 and the shape of the washing piece 20 shown in FIG. 3, or other essentially similar shapes, are examples of the various possible shapes. The shapes shown are, however, particularly advantageous for washing the inner and outer surfaces of glasses, such as wine glasses or other drinking vessels. The guiding piece 10 shown in FIG. 2 has a circular cross-section. The guiding piece 10 is thus provided with attaching projections 14 to prevent the washing piece 20 from moving with respect to the guiding piece 22 (rotating around its longitudinal axis) during washing. The attaching projections 14 thus attach to and/or press against the surface of the space 22 of the washing piece 20, thus preventing movement. To prevent the washing piece 20 from moving, the guiding piece 10 can be made to have an angular, for example square, cross-section (not shown in the Figures), in which case the corners of the guiding piece 10 will act in the same way as the attaching projections 14 shown in FIG. 2, preventing the above-mentioned movement of the washing piece 20. It is obviously possible for the washing piece and guiding piece to be joined together permanently. The washing piece 20 and the guiding piece 10 may, for example, be glued to one another.

FIG. 5 shows another preferred embodiment of the washing piece fitted around the guiding piece 10 of FIG. 2. The washing piece is denoted by reference numeral 20'. The shape of the wall 21' of the washing piece 20' has been selected so as to be particularly well suited for washing baby feeding bottles. On the surface of the wall 21' of the washing piece 20' is made a collar 21*a*' at suitable point, which facilitates especially the washing of the collar part of a baby feeding bottle, which is normally a difficult part of the feeding bottle to wash. The length of the washing pieces 20 and 20' and their other measurements, such as the greatest width, may obviously be selected according to individual requirements.

Guiding pieces of several different dimensions and designs are required for washing different household articles.

FIG. 6 shows yet another preferred alternative for a guiding piece connected to the second end 6 of the handle 2, which is denoted by reference numeral 100, and of the washing piece 120 fitted on it. The washing piece 120 preferably comprises a planar surface 123 for washing planar surfaces such as plates, pans, cutting boards and barbeque bases. The material thickness of the part of the washing piece 120 forming the surface 123 may vary from that shown in FIG. 6 and may be, for example, considerably thicker.

The guiding piece 100 comprises a fastening means 102, which are preferably comprised of a sleeve 102 provided with an internal thread 102*a*, which can be fitted in conjunction with an external thread 6*a* (see FIG. 1) formed at the second end 6 of the handle 2. Here, the guiding piece 100 is structurally a hollow space 101*a* delimited by walls 101 made in the shape of a low cylinder, to which space the water supplied from the second end 6 of the handle 2 discharges. FIG. 6 shows that one wall 101*b* of the guiding piece is essentially perpendicular to the direction of discharge W of the water. FIG. 6 further shows that the at least one wall 101*b* of the guiding piece 100 mentioned above is provided with apertures, or a plurality of apertures 103, the apertures 103 being spaced at appropriate intervals on the said one wall 101*b*. The water supplied to the hollow space 101*a* through the apertures 103 is discharged in a controlled manner to the washing piece 120 fitted around the guiding piece 100. To improve the washing result, detergent (e.g. spherical detergent granules) may be inserted in the space 101*a* of the guiding piece 100 (also in space 11*a* of the guiding piece of FIG. 2), from where they are dosed with the flow of water. To achieve a corresponding result, in the handle 2 may also be a container for a detergent in liquid, granular or powder form. This is dosed either by a separate push button (not shown) or gradually by itself when the water flows through the handle 2.

Should the guiding piece according to the invention not be used at the second end 6 of the handle 2, to the second end may be connected a separate stylised sleeve covering the thread at the second end 6, where there is a similar thread for connection as, for example, in the guiding piece 10.

The present invention is not limited only to the embodiments disclosed, but may be applied in many ways within the scope of protection determined by the claims.

The invention claimed is:

1. An apparatus comprising a faucet spray (1) comprising a handle (2), the faucet spray having a first end (3) which is fixed mechanically to a water hose for supplying water inside the handle and a second end (6) which is equipped with a sprayer head through which the water is arranged to discharge from the handle (2), a first water guiding piece (10, 110) which is provided with a plurality of apertures (13, 103), a water-permeable washing piece (20, 20', 120) which can be fitted around the guiding piece (10, 103) such that water discharging through the plurality of apertures (13, 103) and the washing piece (20, 20', 120) discharges in a controlled manner on a surface of an object to be washed, wherein the first guiding piece (10, 100) comprises (i) fastening means (12) with which the first guiding piece (10, 100) can be fastened removably to the second end of the faucet spray and (ii) an elongate portion comprising the plurality of apertures, wherein the water-permeable washing piece can be fitted to cover substantially an entirety of the elongate portion of the first guiding piece, and wherein the apparatus further comprises at least a second guiding that pieces differs in dimension and shape from the first guiding piece and that may optionally be fastened to the second end (6) of the same faucet spray when the first guiding piece is removed from the second end.

2. The apparatus as claimed in claim 1, wherein the washing piece (20, 20', 120) is provided with a hollow space (22, 122) inside which the entire elongate portion of the first guiding piece (10, 110) can be pushed by stretching the material of the washing piece (20, 20', 120).

3. The apparatus as claimed in claim 1, wherein the outer surface of the washing piece (20, 20', 120) is designed to correspond to the object being washed.

4. The apparatus as claimed in claim 1, wherein the first end (4) of the faucet spray is provided with a water guiding collar (5) or shoulder which can be brought in conjunction with the storage point of the faucet spray (1).

5. The apparatus as claimed in claim 1, wherein the washing piece (20, 20', 120) is made of polyurethane, polyester, polyamide, polypropene and/or nonwoven fabric.

6. The apparatus as claimed in claim 1, wherein the elongate portion of the guiding piece (22, 122) has an angular cross-section or is provided with attaching projections (14) for preventing the washing piece (20, 20', 120) from moving with respect to the first guiding piece (22, 122) during washing.

7. The apparatus as claimed in claim 1, wherein the first guiding piece (22, 122) is glued to the washing piece (20, 20', 120) to prevent the washing piece (20, 20', 120) from moving with respect to the guiding piece (22, 122) during washing.

8. The apparatus as claimed in claim 1, wherein the guiding piece (10, 100) comprises a hollow space (11*a*, 101*a*) which can be provided with detergent.

9. The apparatus as claimed in claim 1, wherein, in an area near the first end, the faucet spray comprises a water guiding collar (5) which expands towards the first end (3).

10. The apparatus as claimed in claim 1, wherein the second guiding piece comprises (i) a first end with means for detachably attaching the second guiding piece to the second end of the faucet spray and (ii) an elongate portion comprising a plurality of apertures; the apparatus further comprising a second washing piece that is configured to fit over substantially an entirety of the elongate portion of the second washing piece.

11. The apparatus as claimed in claim 10, wherein the elongate portion of the second guiding piece, when detachably attached to the second end of the faucet spray, extends perpendicular to a direction through which the water is arranged to discharge from the handle.

12. The apparatus as claimed in claim 10, wherein the plurality of apertures of the second guiding piece extend along a majority of a length of the elongate portion of the second guiding piece.

13. The apparatus as claimed in claim 10, wherein the second water guiding piece is a unitary object.

14. The apparatus as claimed in claim 1, wherein the plurality of apertures of the first guiding piece extend along a majority of a length of the elongate portion of the first guiding piece.

15. The apparatus as claimed in claim 1, wherein the first water guiding piece is a unitary object.

16. The apparatus as claimed in claim 1, wherein the first guiding piece consists of the fastening means and the elongate portion.

17. The apparatus as claimed in claim 6, wherein the first guiding piece consists of the fastening means and the elongate portion.

* * * * *